United States Patent [19]

Wada et al.

[11] Patent Number: 4,477,699

[45] Date of Patent: Oct. 16, 1984

[54] MECHANICAL TWO-WAY LOUDSPEAKER

[75] Inventors: Yasumitsu Wada; Isao Yamamuro, both of Saitama, Japan

[73] Assignee: Pioneer Electronic Corporation, Tokyo, Japan

[21] Appl. No.: 356,702

[22] Filed: Mar. 10, 1982

[30] Foreign Application Priority Data

Mar. 24, 1981 [JP] Japan ..... 56-40289[U]

[51] Int. Cl.[3] ..... H04R 1/24; H04R 9/06

[52] U.S. Cl. ..... 179/116; 179/115.5 PS; 179/181 R; 179/181 F; 181/144; 181/163

[58] Field of Search ..... 179/116, 115.5 PS, 115.5 R, 179/182 A, 181 R, 181 F; 181/144, 163, DIG. 1

[56] References Cited

U.S. PATENT DOCUMENTS 1,097,449 5/1933 Sefton et al. ..... 181/163
2,565,069 8/1951 Engholm ..... 179/116
3,351,719 11/1967 Schoengold ..... 179/115.5 R
4,198,550 4/1980 Matsuda et al. ..... 179/181 R
4,232,204 11/1980 Rojas ..... 179/115.5 PS

FOREIGN PATENT DOCUMENTS 857413 12/1960 United Kingdom ..... 179/116

*Primary Examiner*—Gene Z. Rubinson
*Assistant Examiner*—Danita R. Byrd
*Attorney, Agent, or Firm*—Sughrue, Mion, Zinn, Macpeak & Seas

[57] ABSTRACT

A mechanical two way loudspeaker includes a low frequency diaphragm arranged coaxially with one another which are driven by the same voice coil. In order to flatten the sound pressure versus frequency characteristic of the loud speaker in the high frequency range, the low frequency diaphragm is provided with a flat sound wave radiation surface. The flat surface may be of a honey-comb configuration, or may be made of a low density synthetic foam.

14 Claims, 4 Drawing Figures

MECHANICAL TWO-WAY LOUDSPEAKER

BACKGROUND OF THE INVENTION

One example of a conventional mechanical two-way loudspeaker is shown in FIG. 1. A conical diaphragm 4" for the low frequency range (hereinafter referred to as the low frequency diaphragm) is fixedly secured through an edge 3 to the mounting edge 2A of a frame 2 fixedly mounted on a magnetic circuit 1. A diaphragm 5 for the high frequency range (hereinafter referred to as the high frequency diaphragm) is fixedly secured through an edge 6 to the low frequency diaphragm 4" in such a manner that the diaphragms 4" and 5 are coaxial with one other. A voice coil bobbin 7 fixedly secured to the inner peripheral edges of the low frequency diaphragm 4" and the high frequency diaphragm 5, and a voice coil 8 wound on the voice coil bobbin 7 are inserted into the magnetic gap 1A of the magnetic circuit 1. In FIG. 1, reference numeral 10 designates a damper which supports the voice coil bobbin 7.

When a current bearing sound signals flows in the voice coil 8 in the magnetic gap 1A of the magnetic circuit 1, it is vibrated in response to the sound current according to Fleming's left-hand rule, so that the high frequency diaphragm 5 and the low frequency diaphragm 4" are operated sharing the vibration; more specifically, in the high frequency range, the low frequency diaphragm 4" is not sufficiently vibrated, while the high frequency diaphragm 5 is primarily vibrated, and in the low frequency range both the low frequency diaphragm 4" and the high frequency diaphragm 5 are vibrated. This is a specific feature of the conventional loudspeaker.

However, in the above-described conventional mechanical two-way loudspeaker, the sound pressure from the low frequency diaphragm 4" which is conical and provided behind the high frequency diaphragm 5, interferes with the sound pressure vs. frequency characteristic of the high frequency diaphragm 5 during vibration, as a result of which this characteristic is not flat, as is desired.

SUMMARY OF THE INVENTION

In view of the foregoing, an object of this invention is to provide a mechanical two-way loudspeaker in which the sound pressure vs. frequency characteristic of the high frequency diaphragm in the high frequency range is made flat, by making the sound wave radiation surface of the low frequency diaphragm flat.

DETAILED DESCRIPTION OF THE PREFERRED EMBODIMENTS

Figure 2:
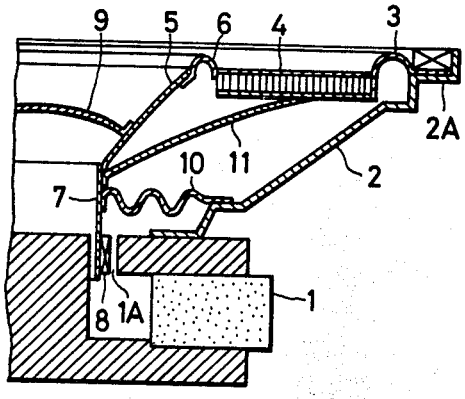
FIG. 2 is a sectional view of one example of a mechanical two-way loudspeaker according to the invention.

A first embodiment of the invention will be described with reference to FIG. 2.

Figure 1:
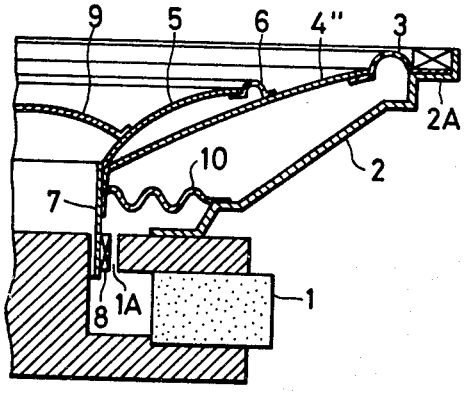
FIG. 1 (PRIOR ART)
FIG. 1 is a sectional view illustrating one example of a conventional mechanical two-way loudspeaker.

In this embodiment, the low frequency diaphragm 4 has an acoustic wave radiation surface which is in the form of a flat plate. The internal structure of the low frequency diaphragm 4 is provided in a honey-comb configuration in order to increase its rigidity because the low frequency diaphragm 4 undergoes rigid motion, as a whole, in the low frequency range. In FIG. 2, reference numeral 11 designates a sub-cone for driving the low frequency diaphragm 4. The sub-cone 11 has its inner periphery bonded to a voice coil bobbin 7 with adhesive or the like, and its outer periphery bonded to the lower surface of the low frequency diaphragm 4, to support the latter. More specifically, the outer periphery of the sub-cone 11 is bonded to the low frequency diaphragm 4 so that the sub-cone 11 supports the latter at the node of the free vibration of the low frequency diaphragm, or near the node, whereby divisional vibration, which otherwise may be caused during the vibration of the low frequency diaphragm 4, is prevented, i.e., the low frequency diaphragm 4 is efficiently vibrated. The outer periphery of the low frequency diaphragm 4 is supported through an edge 3 by the mounting edge 2A of the frame 2, and the inner periphery is supported through an edge 6 by the outer periphery of the high frequency diaphragm 5. In FIG. 2, those components which have been described with reference to FIG. 1 are designated by the same reference numerals or characters, and therefore the detailed description thereof will be omitted.

The loudspeaker, according to this first embodiment, is constructed as described above. When a sound current flows in the voice coil 8, the voice coil 8 in the magnetic gap 1A of the magnetic circuit 1 is vibrated according to Fleming's lefthand rule in response to the magnetic flux induced therein, and simultaneously the voice coil bobbin 7 is vibrated. In the high frequency range, in association with the vibration of the voice coil bobbin 7, only the high frequency diaphragm 5 is vibrated to reproduce high frequency sound. However, in this case, the vibration is not sufficiently transmitted to the low frequency diaphragm 4 because of the compliance of the vicinity of the neck of the sub-cone 11, the outer periphery of which is bonded to the lower surface of the low frequency diaphragm 4, and accordingly the low frequency diaphragm 4 does not comply with the vibration of the voice coil bobbin 7. The low frequency diaphragm 4, which is coaxial with the conical high frequency diaphragm 5 and surrounds the latter has a sound wave radiation surface which is in the form of a flat plate, as described above. Therefore, in this loudspeaker, unlike the mechanical two-way loudspeaker in which the high frequency diaphragm 5 and the low frequency diaphragm 4" are coaxial with each other and overlap each other, the sound pressure vs. frequency characteristic of the high frequency diaphragm 5 in the high frequency range is not affected by the low frequency diaphragm 4, and accordingly the sound pressure vs. frequency characteristic in the high frequency range of the loudspeaker is flat.

Sound reproduction in the low frequency range proceeds as follows: When a sound current flows in the voice coil 8, the low frequency diaphragm 4 having the flat-plate-shaped sound wave radiation surface is vibrated by the voice coil bobbin 7 and the sub-cone 11, while the high frequency diaphragm 5 is vibrated by the voice coil bobbin 7; that is, the diaphragms make rigid motion as a whole, to reproduce low frequency sounds.

The flat-plate-shaped low frequency diaphragm 4 is substantially in the form of a ring, and the inner periphery is fixedly connected through the edge 6 to the high frequency diaphragm 5 which is driven simultaneously. Therefore, when the loudspeaker is driven, a large vibration is liable to occur near the inner periphery; however, it is prevented in this embodiment because one sub-cone 11 is bonded to the substantial middle of the low frequency diaphragm 4. Thus, large vibration prevention can be achieved without increasing the number of sub-cones or the mass of the sub-cone.

In the above-described embodiment, the low frequency diaphragm 4 having the flat-plate-shaped sound wave radiation surface is not integral with the edge 3; however, if the components 3 and 4 are formed as one unit, installing the low frequency diaphragm 4 on the frame 2 can readily be achieved in assembling the loudspeaker.

Figure 3:
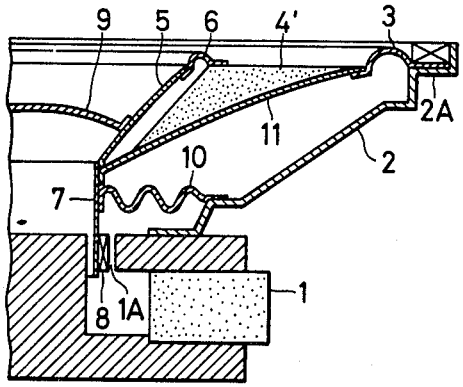
FIG. 3 is a sectional view showing another example of the mechanical two-way loudspeaker according to the invention.
Figure 4:
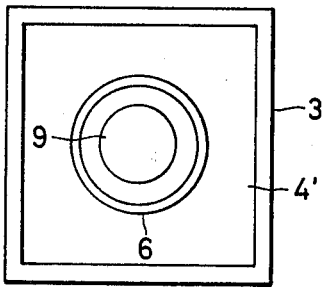
FIG. 4 is a plan view of the loudspeaker shown in FIG. 3.

FIGS. 3 and 4 show a second embodiment of the invention. In this embodiment, the low frequency diaphragm 4' is made of a foamed synthetic resin which is light-weight and large in internal loss, in such a manner that it has an upper surface, which is the sound wave radiation surface, in the form of a flat plate. The upper surface is square or rectangular, as shown in FIG. 4. With this low frequency diaphragm 4', unlike one which is flat and circular, the vibrating area can be increased for a given size enclosure.

Similarly as in the first embodiment, the sound wave radiation surface of the low frequency diaphragm 4' is flat. Therefore, the sound pressure vs. frequency characterisic of the high frequency diaphragm 5 in the high frequency range is not affected by the low frequency diaphragm 4', and accordingly the sound pressure vs. frequency characteristic of the loudspeaker in the high frequency range is flat.

What is claimed is:

1. A mechanical two-way loudspeaker, comprising: a low frequency diaphragm for reproducing sounds in a low frequency range, a high frequency diaphragm for reproducing sound in a high frequency range, said high frequency diaphragm being arranged coaxially with said low frequency diaphragm, both of said diaphragms being driven by the same voice coil, said low frequency diaphragm being provided with a flat sound wave radiation surface entirely disposed in an area radially outward from an area in which said high frequency diaphragm is disposed.

2. A loudspeaker as claimed in claim 1, further comprising means connecting an innermost radial peripheral edge of said low frequency diaphragm to an outermost radial peripheral edge of said high frequency diaphragm.

3. A loudspeaker as claimed in claim 1, further comprising a sub-cone connected at one end to a voice coil bobbin, and at its other end to an intermediate portion of the low frequency diaphragm.

4. A loudspeaker as claimed in claim 1, said high frequency diaphragm being bonded to said low frequency diaphragm at the periphery thereof, said low frequency diaphragm comprising a synthetic foamed material, a sub-cone connected between a voice coil bobbin of said loudspeaker and an outer peripheral portion of said loud speaker, the under-side of said low frequency diaphragm following the contours of said sub-cone.

5. A loudspeaker as claimed in claim 1, said innermost radial peripheral edge of said low frequency diaphragm being substantially coplanar with said outermost radial peripheral edge of said high frequency diaphragm.

6. A loudspeaker as claimed in claim 2, wherein the internal structure of said low frequency diaphragm is of a honey-comb configuration, in order to increase the rigidity thereof.

7. A loudspeaker as claimed in claim 2, said low frequency diaphragm comprising a foamed synthetic resin material.

8. A loudspeaker as claimed in claim 6 or 7, wherein the sound wave radiation surface of said low frequency diaphragm is of square or rectangular shape.

9. A loudspeaker as claimed in claim 2, said low frequency diaphragm being ring-shaped.

10. A loudspeaker as claimed in claim 2, said innermost radial peripheral edge of said low frequency diaphragm and said outermost radial peripheral edge of said high frequency diaphragm being circular.

11. A loudspeaker as claimed in claim 10, said connecting means comprising a single circular intermediate member.

12. A loudspeaker as claimed in claim 3, said intermediate portion comprising a middle portion of said low frequency diaphragm.

13. A mechanical two-way loudspeaker, comprising:

a low frequency diaphragm for reproducing sounds in a low frequency range;

a high frequency diaphragm for reproducing sound in a high frequency range, said high frequency diaphragm being arranged coaxially with said low frequency diaphragm, both of said diaphragms being driven by the same voice coil, said low frequency diaphragm being provided with a flat sound wave radiation surface; and a sub-cone connected at one end to a voice coil bobbin, and at its other end to an intermediate portion of the low frequency diaphragm.

14. A mechanical two-way loudspeaker, comprising;

a low frequency diaphragm for reproducing sounds in a low frequency range;

a high frequency diaphragm for reproducing sound in a high frequency range, said high frequency diaphragm being arranged coaxially with said low frequency diaphragm, both of said diaphragms being driven by the same voice coil, said low frequency diaphragm being provided with a flat sound wave radiation surface;

said high frequency diaphragm being bonded to said low frequency diaphragm at the periphery thereof, said low frequency diaphragm comprising a synthetic foamed material; and A sub-cone connected between a voice coil bobbin of said loudspeaker and an outer peripheral portion of said loudspeaker, the underside of said low frequency diaphragm following the contours of said sub-cone.

* * * * *